US011346313B2

(12) United States Patent
Carlson et al.

(10) Patent No.: US 11,346,313 B2
(45) Date of Patent: May 31, 2022

(54) FUEL FLOW LIMITER ASSEMBLY HAVING INTEGRAL FUEL FILTER AND FUEL SYSTEM USING SAME

(71) Applicant: Caterpillar Inc., Peoria, IL (US)

(72) Inventors: Joshua D. Carlson, Peoria, IL (US); Stephen Robert Lewis, Chillicothe, IL (US); Kenneth Carroll Adams, Dunlap, IL (US); Daniel Richard Ibrahim, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/011,635

(22) Filed: Sep. 3, 2020

(65) Prior Publication Data

US 2022/0065208 A1 Mar. 3, 2022

(51) Int. Cl.

| | |
|---|---|
| ***F02M 63/00*** | (2006.01) |
| ***F02M 61/16*** | (2006.01) |
| ***F02M 55/02*** | (2006.01) |
| ***F02M 59/34*** | (2006.01) |

(52) U.S. Cl.

CPC ..... *F02M 63/0056* (2013.01); *F02M 55/025* (2013.01); *F02M 59/34* (2013.01); *F02M 61/165* (2013.01); *F02M 63/0054* (2013.01); *F02M 2200/27* (2013.01)

(58) Field of Classification Search

CPC ..... F02M 63/0056; F02M 59/34

See application file for complete search history.

(56) References Cited

U.S. PATENT DOCUMENTS

| | | | | |
|---|---|---|---|---|
| 3,791,589 A | | 2/1974 | Pagdin | |
| 4,539,959 A | * | 9/1985 | Williams | F02M 55/02 123/198 DB |
| 4,589,393 A | * | 5/1986 | Jourde | F02M 63/0215 123/198 DB |
| 4,830,046 A | * | 5/1989 | Holt | F16K 17/30 137/460 |
| 5,215,113 A | * | 6/1993 | Terry | F16K 17/30 137/460 |
| 5,462,081 A | * | 10/1995 | Perusek | F16K 17/30 137/498 |
| 5,503,127 A | * | 4/1996 | Djordjevic | F02M 41/1405 123/450 |
| 5,692,476 A | * | 12/1997 | Egler | F02M 63/0205 123/456 |
| 5,884,606 A | * | 3/1999 | Kellner | F16K 31/0613 123/446 |

(Continued)

FOREIGN PATENT DOCUMENTS

JP 11107884 A 4/1999

*Primary Examiner* — Kevin R Steckbauer

(74) *Attorney, Agent, or Firm* — Brannon Sowers & Cracraft

(57) ABSTRACT

A fuel flow limiter assembly includes a limiter body forming a central bore, and including a shutoff piston within the central bore having a closing hydraulic surface exposed to a fluid pressure of the fuel inlet, and being movable from an open position, to a closed position based on a fuel pressure drop from a fuel inlet to a fuel outlet in the limiter assembly. A fuel filter is resident in the limiter assembly and supported in a connector coupled to the limiter body. The fuel filter is elongate and projects from the connector into a fuel flow path from the fuel inlet to the fuel outlet.

20 Claims, 3 Drawing Sheets

(56) References Cited

U.S. PATENT DOCUMENTS 6,408,870 B1 * 6/2002 Dulin ..... F16K 17/30 137/462
6,644,345 B2 * 11/2003 Dulin ..... F16K 17/30 137/462
6,840,268 B2 * 1/2005 Kennedy ..... F02M 61/14 137/504
6,953,052 B2 * 10/2005 Lehtonen ..... F02M 63/0215 137/517
6,981,516 B1 * 1/2006 VanOsdol ..... B01D 46/0087 137/260
7,007,708 B2 * 3/2006 Burke ..... F02M 63/005 123/506
7,140,386 B2 * 11/2006 Avis ..... F16K 17/30 137/504
7,216,631 B2 * 5/2007 Nishiwaki ..... F02M 63/0205 123/467
7,258,131 B2 * 8/2007 Eichler ..... F16K 17/30 137/460
7,293,721 B2 * 11/2007 Roberts ..... B05B 1/3013 137/71
7,487,759 B2 * 2/2009 Ochiai ..... F02M 55/025 123/469
7,658,179 B2 * 2/2010 Bock ..... F02M 63/0205 123/467
7,686,235 B2 * 3/2010 Roberts ..... B05B 1/3006 239/204
8,596,247 B2 * 12/2013 Tower ..... F02M 55/02 123/470
8,622,046 B2 * 1/2014 Gerstner ..... F02M 55/025 123/447
9,038,601 B2 * 5/2015 Morris ..... F02M 51/061 123/467
9,234,488 B2 * 1/2016 Gerstner ..... F02M 55/04
9,279,403 B2 * 3/2016 Pasedach ..... F02M 63/0205
9,803,603 B2 * 10/2017 Ganser ..... F02M 55/005
11,008,990 B2 * 5/2021 Medoro ..... F02M 31/125
2003/0217726 A1 * 11/2003 Kennedy ..... F02M 55/02 123/198 D
2009/0212134 A1 8/2009 Drake et al.
2009/0295100 A1 * 12/2009 Bock ..... F02M 63/0215 277/591
2011/0315117 A1 * 12/2011 Gerstner ..... F02M 63/0054 123/447
2013/0104853 A1 * 5/2013 Morris ..... F02M 63/0215 123/467
2013/0298873 A1 * 11/2013 Pasedach ..... F02M 63/0205 123/456
2014/0182550 A1 * 7/2014 Gerstner ..... F02M 55/02 123/445
2014/0352664 A1 * 12/2014 Coldren ..... F02D 19/0694 123/445
2015/0345448 A1 * 12/2015 Gerstner ..... F02M 63/0054 123/456
2019/0309714 A1 * 10/2019 Medoro ..... F02M 59/34
2019/0383225 A1 * 12/2019 Medoro ..... F02M 37/40

* cited by examiner

FUEL FLOW LIMITER ASSEMBLY HAVING INTEGRAL FUEL FILTER AND FUEL SYSTEM USING SAME

TECHNICAL FIELD

The present disclosure relates generally to a fuel flow limiter assembly in a pressurized fuel system, and more particularly to a fuel flow limiter assembly having an integrated fuel filter.

BACKGROUND

Pressurized fuel systems are well-known and widely used in internal combustion engines. In one example, a pressurized fuel reservoir is supplied with pressurized fuel from a single pump and makes the pressurized fuel available for delivery and injection into combustion cylinders in the engine by way of fuel injectors. Other pressurized fuel injection systems utilize so-called unit pumps where individual cam actuated or hydraulically actuated fuel pressurization pumps are associated with each fuel injector. Various extensions and alternatives to these two basic constructs have been proposed over the years.

In recent years the desirability of ever higher fuel injection pressures has been widely recognized. High fuel pressures can enable tiny amounts of fuel to be injected rapidly and precisely, and provide improved atomization and other properties to mitigate certain undesired emissions.

Such systems tend to be highly sensitive to debris, however, as small particles present in fuel supplied into the system, or produced by components in the system itself, can interfere with the motion of rapidly moving fuel injector and pump components or otherwise cause performance degradation. Engineers have experimented for many years with different strategies for filtering fuel to remove particles, including systems where all of the fuel is filtered upstream of a pressurized fuel reservoir, and also systems where fuel is filtered between a pressurized fuel reservoir and individual fuel injectors. One example pressurized fuel system employing fuel filtration between a pressurized fuel reservoir and a fuel injector is set forth in United States Patent Application Publication No. 20150345448A1 to Gerstner et al. While the strategy set forth in the '448 application may have certain advantages and applications, there is always room for improvement and development of alternative strategies.

SUMMARY OF THE INVENTION

In one aspect, a fuel flow limiter assembly includes a limiter body defining a longitudinal axis extending between a first axial body end and a second axial body end, and including an axially extending central bore, and a fuel inlet formed in the first axial body end and fluidly connected to the central bore. The limiter assembly further includes a connector coupled to the second axial body end, and including a fuel outlet fluidly connected to the central bore. The limiter assembly further includes a shutoff piston within the central bore and including a closing hydraulic surface exposed to a fluid pressure of the fuel inlet, and a sealing surface. The shutoff piston is movable within the central bore in a direction of the second axial body end from an open position, to a closed position where the sealing surface is in contact with the connector to block fuel flow from the fuel inlet to the fuel outlet. The limiter assembly further includes a biasing spring trapped between the shutoff piston and the connector and biasing the shutoff piston toward the open position, and a fuel filter supported in the connector. The fuel filter projects from the connector in the direction of the first axial body end in a fuel flow path from the fuel inlet to the fuel outlet.

In another aspect, a fuel system for an internal combustion engine includes a pressurized fuel reservoir, a plurality of fuel injectors fluidly connected to the pressurized fuel reservoir, and a plurality of flow limiter assemblies each positioned fluidly between the pressurized fuel reservoir and at least one of the plurality of fuel injectors. Each of the plurality of flow limiter assemblies defines a longitudinal axis and includes a fuel inlet, a fuel outlet, a central bore, a biasing spring, and a shutoff piston positioned in the central bore, and movable in opposition to a bias of the biasing spring to a closed position based on a fuel pressure drop from the fuel inlet to the fuel outlet. Each of the plurality of flow limiter assemblies further includes a fuel filter having a filter inlet surface exposed to a flow of fuel in the central bore, and a filter outlet surface forming a filtered fuel passage extending to the fuel outlet, in the respective flow limiter assembly.

In still another aspect, a fuel feed subsystem for a fuel injector includes a leakage containment housing structured to couple with a pressurized fuel reservoir, and a fuel flow limiter assembly within the leakage containment housing. The fuel flow limiter assembly includes a limiter body defining a longitudinal axis, and a connector coupled to the limiter body. The limiter body has a fuel inlet formed therein and an axially extending central bore fluidly connected to the fuel inlet. The connector has a fuel outlet formed therein and fluidly connected to the central bore. The fuel flow limiter assembly further includes a biasing spring, and a shutoff piston including a closing hydraulic surface exposed to a fluid pressure of the fuel inlet, and a sealing surface. The shutoff piston is movable within the central bore in opposition to a biasing force of the biasing spring from an open position to a closed position to block fuel flow from the fuel inlet to the fuel outlet. The subsystem further includes a fuel filter resident in the fuel flow limiter assembly and supported in the connector such that the fuel filter projects from the connector in an upstream direction relative to a fuel flow path from the fuel inlet to the fuel outlet.

DETAILED DESCRIPTION

Figure 1:
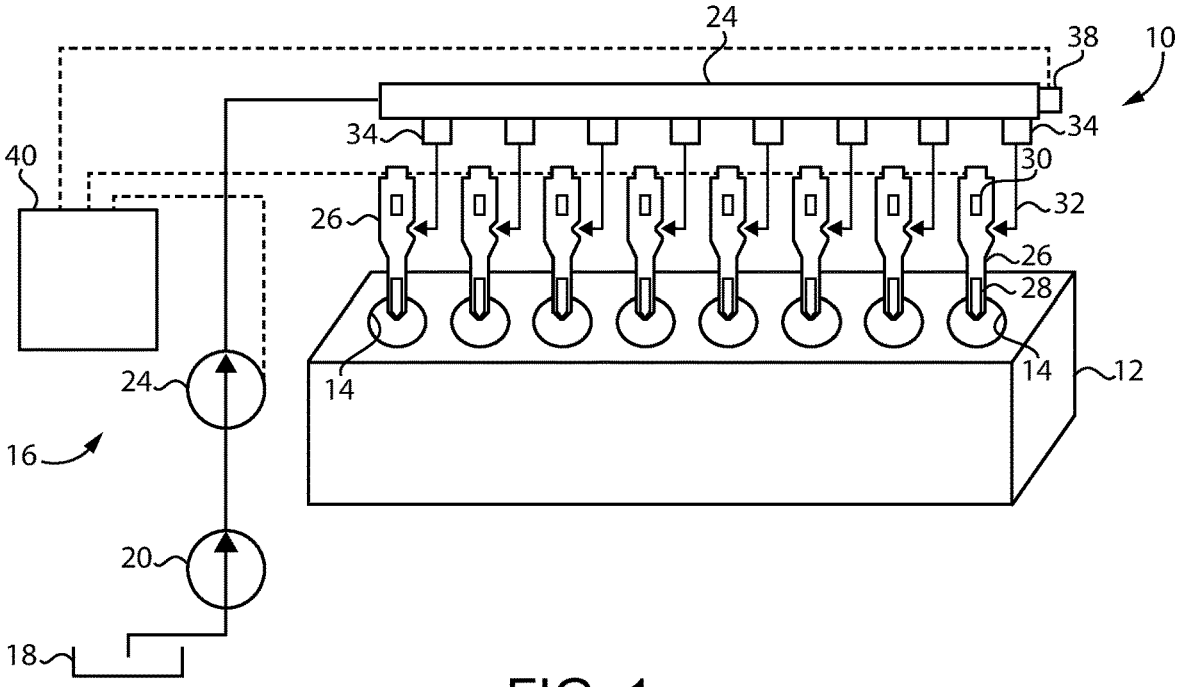
FIG. 1 is a diagrammatic view of an internal combustion engine system, according to one embodiment.

Referring to FIG. 1, there is shown an internal combustion engine system 10 according to one embodiment. Internal combustion engine system 10 includes an engine 12 including a plurality of combustion cylinders 14. Each of combustion cylinders 14 is associated with a piston (not shown) structured to compress a mixture of a fuel and air for combustion to rotate a crankshaft in a generally conventional manner. Engine system 10 can be implemented in a mobile machine, a stationary generator set for producing electrical power, in a pump, a compressor, or in a wide variety of other applications. Engine system 10 may be structured to operate on a liquid fuel such as a liquid diesel distillate fuel, and will typically be compression-ignited for operation in a conventional four cycle pattern, although the present disclosure is not thereby limited. Engine 12 can include any number of cylinders in any suitable arrangement.

Engine system 10 also includes a pressurized fuel system 16 having a fuel tank 18, a low pressure pump 20, a high pressure pump 22, and a pressurized fuel reservoir 24. A plurality of fuel injectors 26 are coupled to pressurized fuel reservoir 24 and positioned to directly inject liquid fuel into combustion cylinders 14. Each fuel injector 26 includes an outlet check 28, and an electrically actuated control valve assembly 30. Fuel system 16 also includes a plurality of fuel feed lines 32 extending between reservoir 24 and fuel injectors 26. Feed lines 32 may include so-called quill connectors in one embodiment. A pressure sensor 38 may be coupled with reservoir 24 and structured to monitor fuel pressure therein in a generally known manner. Fuel system 16 may be implemented as a so-called common rail fuel system, where a single monolithic pressurized fuel reservoir is provided to simultaneously feed pressurized fuel at an injection pressure to all of fuel injectors 26. In other embodiments a plurality of separate pressurized fuel reservoirs in the nature of accumulators might be used with each associated with one or more fuel injectors. An electronic control unit 40 is shown coupled with high pressure pump 24, with pressure sensor 38 and with each of fuel injectors 26 to monitor and electronically control operation of these and other components in a generally known manner. Based on a pressure signal from pressure sensor 38, electronic control unit 40 may control high pressure fuel pump 24 to maintain fuel pressure at a desired level. Fuel system 16 also includes a plurality of fuel flow limiter assemblies 34 each positioned fluidly between pressurized fuel reservoir 24 and one of fuel injectors 26, in the illustrated embodiment, features and functionality of which will be further apparent from the following description.

Figure 2:
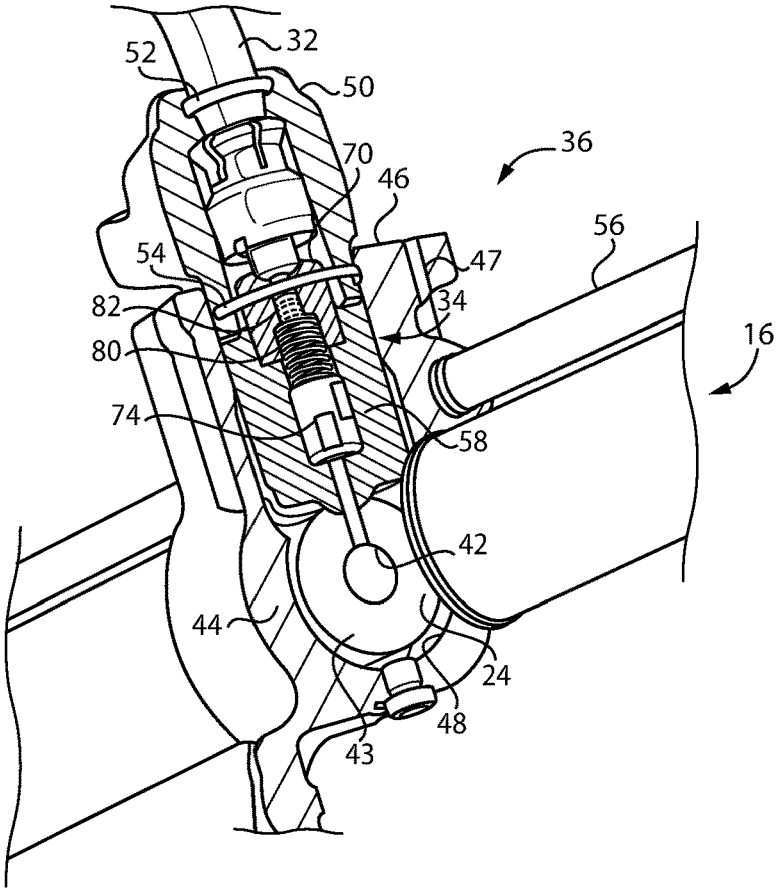
FIG. 2 is a partially sectioned diagrammatic view of a fuel feed subsystem, according to one embodiment.

Referring also now to FIG. 2, there are shown additional features of fuel system 16 in further detail. Each fuel flow limiter assembly 34, hereinafter referred to in the singular, may be part of a fuel feed subsystem 36 structured to limit a flow of fuel to one or more fuel injectors 26 and also to filter the flow of fuel by way of an integral fuel filter 82. Fuel feed subsystem 36 includes a leakage containment housing 46 structured to couple with pressurized fuel reservoir 24. Fuel system 16 may include a plurality of similar or identical fuel feed subsystems and a plurality of leakage containment housings receiving a plurality of flow limiter assemblies, all structured similarly or identically to the components shown in FIG. 2. A plurality of seals to be described may fluidly seal flow limiter assemblies within the respective leakage containment housings. As can be seen in FIG. 2 pressurized fuel reservoir 24 defines a fuel cavity 42 and forms an inner wall 43 containing pressurized fuel in fuel cavity 42. Housing 46 is coupled to reservoir 24 and forms an outer wall 42, such that a leakage cavity 48 extends between inner wall 43 and outer wall 44 to contain fugitive, leaked or otherwise expelled fuel and convey the same back to fuel tank 18, such as by way of a return line 56. Housing 46 may form a first housing piece 47. A second housing piece 50 of housing 46 is coupled to first housing piece 47, such as by way of clamping with fasteners not shown in FIG. 2. Feed line/quill connector 32 is shown supported in second housing piece 50, with a seal such as an O-ring seal 52, fluidly sealing between second housing piece 50 and feed line/quill connector 32. Another seal 54 fluidly seals between first housing piece 47 and second housing piece 50.

Figure 3:
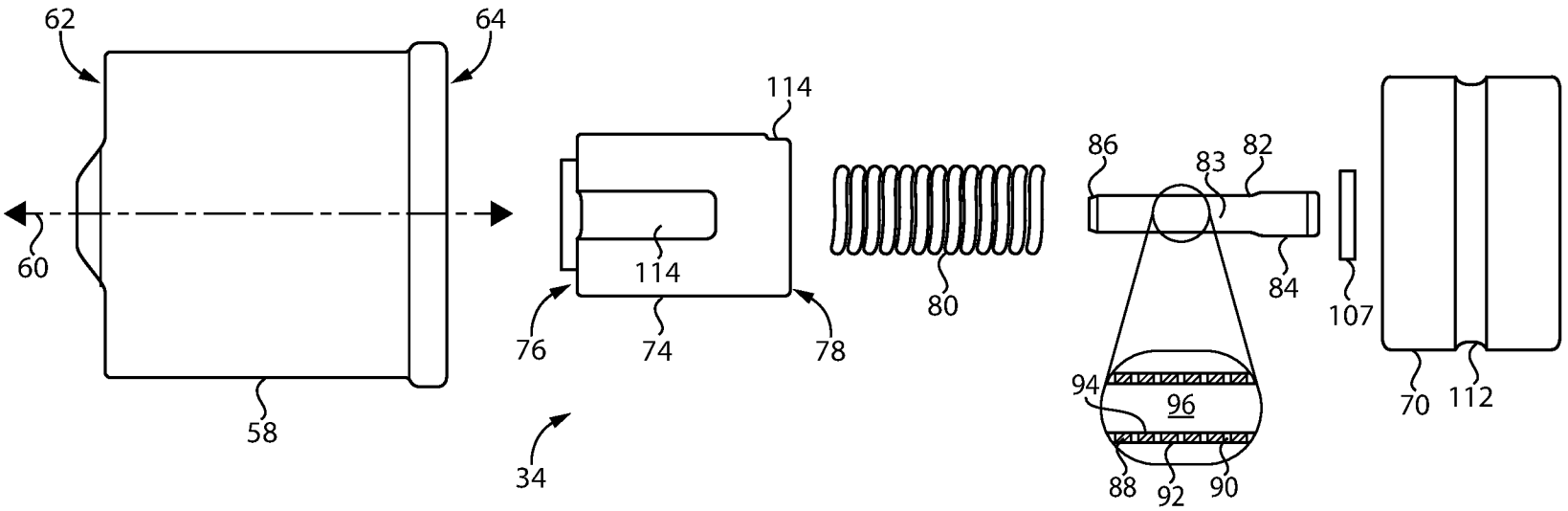
FIG. 3 is an exploded view of a fuel flow limiter assembly, according to one embodiment.

Referring also now to FIG. 3, flow limiter assembly 34 includes a limiter body 58 defining a longitudinal axis 60 extending between a first axial body end 62 and a second axial body end 64. Flow limiter assembly 34 also includes a connector 70, coupled to second axial body end 64 when flow limiter assembly 34 is assembled for service. Flow limiter assembly 34 also includes a shutoff piston 74 having a closing hydraulic surface 76 and a sealing surface 78. A biasing spring 80 is trapped between shutoff piston 74 and connector 70 when assembled for service. Also shown in FIG. 3 is a spacer 107 trapped between connector 70 and biasing spring 80 when assembled for service. A groove 112 extends circumferentially around connector 70. Shutoff piston 74 can include a variety of configurations, and in the illustrated embodiment includes flow channels 114 structured to permit fuel flow around and past shutoff piston 74 for feeding the flow of fuel through fuel filter 82 and ultimately to one or more of fuel injectors 26.

Also shown in FIG. 3 is a detailed enlargement of a portion of fuel filter 82. Fuel filter 82 includes an elongate perforated filter body 83 having a perforated cylindrical wall 88, having a plurality of holes 90 formed therein. Holes 90 communicate between a filter inlet surface 92 formed on wall 88, and a filter outlet surface 94 formed on wall 88 and forming a filtered fuel passage 96. Fuel filter 82 may be a single metallic piece wherein holes 90 are laser drilled, although certain other filter types and manufacturing methods could be used. Cylindrical wall 88 extends circumferentially around longitudinal axis 60 when assembled for service.

Figure 4:
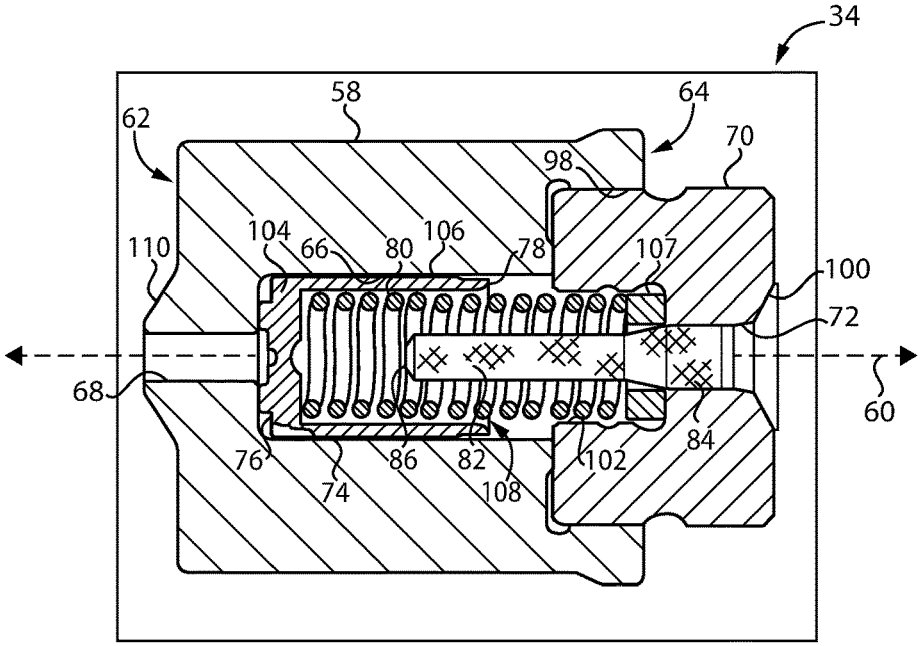
FIG. 4 is a sectioned side diagrammatic view of a fuel flow limiter assembly in an open configuration.

Referring also now to FIG. 4, there is shown flow limiter assembly 34 as it might appear in an open position. As discussed above, limiter body 58 includes a first axial body end 62 and a second axial body end 64. Limiter body 58 also includes an axially extending central bore 66, and a fuel inlet 68 formed in first axial body end 62 and fluidly connected to central bore 66. Central bore 66 may or may not be centered on longitudinal axis 60, but longitudinal axis 60 will typically pass through central bore 66. Fuel inlet 68 may be formed in a sealing protrusion 110 extending axially outward of first axial body end 62, and spherically shaped or otherwise profiled so as to form a line contact metal-to-metal seal with pressurized fuel reservoir 24. Connector 70 is coupled to second axial body end 64, and includes a fuel outlet 72 fluidly connected to central bore 66. Fuel inlet 68 and fuel outlet 72 may be centered on longitudinal axis 60. Filtered fuel passage 96 extends to fuel outlet 72. Shutoff piston 74 is positioned within central bore 66 such that closing hydraulic surface 76 is exposed to a fluid pressure of fuel inlet 68. Shutoff piston 74 is movable within central bore 66, in a direction of second axial body end 64, from the open position as shown in FIG. 4, to a closed position.

Figure 5:
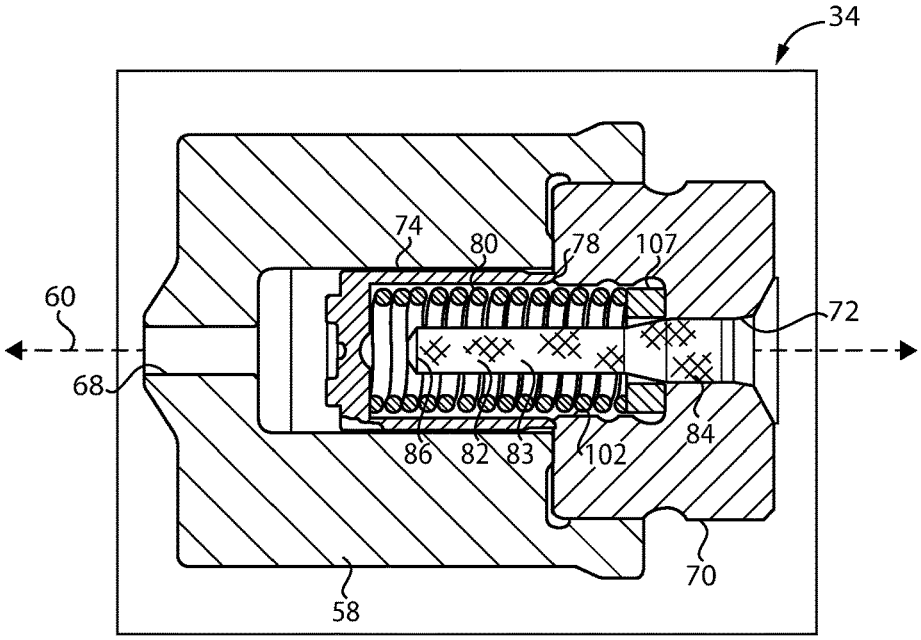
FIG. 5 is a sectioned side diagrammatic view of a fuel flow limiter assembly in a closed configuration.

Referring also to FIG. 5, there is shown shutoff piston 74 as it might appear at the closed position where sealing surface 78 is in contact with connector 70 to block fuel flow from fuel inlet 68 to fuel outlet 72. Biasing spring 80 is trapped between shutoff piston 74 and connector 70 and biases shutoff piston 74 toward the open position, such that moving shutoff piston 74 to the closed position occurs in opposition to a biasing force of biasing spring 80. Fuel filter 82 includes an elongate filter body 83 as noted above having an open outlet end 84 supported in connector 70, and an unsupported second end 86 opposite open outlet end 84 and positioned within central bore 66. In an end view, open outlet end 84 would be seen to form a circular opening to filtered fuel passage 96. In an end view of second end 86, filter body is closed, but for holes 90 which may not be visible to the naked eye. It can be noted comparing FIG. 4 and FIG. 5 that second end 86 is within shutoff piston 74 at each of the open position and the closed position of shutoff piston 74, in the illustrated embodiment. Perforated cylindrical wall 88 extends between outlet end 84 and second end 86. Fuel filter 80 may be perforated with holes 90 throughout, although the present disclosure is not thereby limited. Outlet end 84, for example, may be interference-fitted with connector 70 within fuel outlet 72, and might be non-perforated.

Also in the illustrated embodiment limiter body 58 includes a counterbore 98 formed in second axial body end 64. Connector 70 may be formed as a one-piece junction block positioned in counterbore 98, and has a connector seat 100, such as a conical seat, formed therein and extending circumferentially around fuel outlet 72. Connector 70, including a one-piece junction block as noted above but potentially multiple parts, includes a spring bore 102 coaxially arranged with fuel outlet 72 about longitudinal axis 60, and extending between fuel outlet 72 and central bore 66.

Also visible in FIG. 4 and FIG. 5 are additional example details of shutoff piston 74. Shutoff piston 74 includes a head portion 104 having closing hydraulic surface 76 formed thereon, and a skirt portion 106 extending circumferentially around longitudinal axis 60. Biasing spring 80 is received in part within skirt portion 106 and in part within spring bore 102. Spacer 107 may include an annular spacer extending circumferentially around fuel filter 82, and trapped between biasing spring 80 and connector 70 within spring bore 102. Sealing surface 78 may include an annular sealing edge forming a terminal end 108 of skirt portion 106. Fuel filter 84, biasing spring 80, and shutoff piston 74 may be coaxially arranged, about longitudinal axis 60. It will also be appreciated that each of filter inlet surface 92 and filter outlet surface 94 may extend circumferentially around longitudinal axis 60. Fuel filter 84 may be interference-fitted with connector/junction block 70 within fuel outlet 72 as noted above. The single-ended support of fuel filter 82 enables fuel filter 82 to project generally unobstructed from connector 70 in an upstream direction of first axial body end 62 relative to a fuel flow path from fuel inlet 68 to fuel outlet 72. The elongate configuration of fuel filter 82 and projection in a direction of first axial body end 62 enables fuel flow in a generally radially inward direction through holes 90 into filtered fuel passage 96, with particles larger than holes 90 excluded, and optimizes a fuel filter flow area available for filtration to limit a pressure drop across fuel filter 82.

INDUSTRIAL APPLICABILITY

Referring to the drawings generally, engine system 10 may be operated by reciprocating pistons in combustion cylinders 14, and injecting pressurized fuel from pressurized fuel reservoir 24 supplied to each of fuel injectors 26 directly into combustion cylinders 14. Under normal operation outlet checks 28 in each of fuel injectors 26 will remain closed between injection events, and commanded to open for fuel injection using electronic control unit 40 to energize control valve assemblies 30. During fuel injection events fuel will flow through each of the respective flow limiter assemblies 34 to the associated fuel injector 26. Based upon a fuel pressure drop across each flow limiter assembly 34 during fuel injection, the respective shutoff piston 74 may move away from the open position in opposition to a biasing force of biasing spring 80. Ordinarily the fuel injection event will end and biasing spring 80 will urge shutoff piston 74 back toward the fully open position without it reaching its closed portion. Fuel filter 82 filters fuel flowing through central bore 66 to fuel outlet 72 in the manner generally described herein.

In some instances, fuel injectors may experience performance degradation or damage, including valve sticking, electrical actuator failure, problems caused by debris, or other issues, resulting in excess or unmitigated fuel flow from pressurized fuel reservoir 24 into the associated combustion cylinder 14. In such instances, rather than returning towards an open or fully open position at the end of a fuel injection event shutoff piston 74 will move, based on the fuel pressure drop from fuel inlet 68 to fuel outlet 72, to the fully closed position, such that sealing surface 78 in contact with connector 70 effectively shuts off fuel flow and shuts down the associated combustion cylinder. Integrating the functions of flow limiting and filtration can reduce the number of parts and components required in a fuel system such as fuel system 16, while obtaining or retaining full fuel shutoff functionality in association with each combustion cylinder.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

LIST OF ELEMENTS

10 engine system
12 engine
14 cylinders
16 fuel system
18 fuel tank
20 low pressure pump
22 high pressure pump
24 reservoir
26 fuel injector
28 outlet check
30 control valve assembly
32 quill connector
34 limiter assembly
36 fuel feed subsystem
38 pressure sensor
40 electronic control unit
42 cavity
43 inner wall
44 outer wall
46 housing piece
47 first housing piece
48 cavity
50 second housing piece
52 seal
54 seal

56 return line
58 limiter body
60 longitudinal axis
62 first axial body end
64 second axial body end
66 central bore
68 fuel inlet
70 connector
72 fuel outlet
74 shutoff piston
76 closing hydraulic surface
78 sealing surface
80 biasing spring
82 fuel filter
83 filter body
84 outlet end
86 second end
88 cylindrical wall
90 hole
92 filter inlet surface
94 filter outlet surface
96 filtered fuel passage
98 counterbore
100 connector seat
102 spring bore
104 head portion
106 skirt portion
107 spacer
108 terminal end
110 sealing protrusion
112 seal groove
114 flow slots

What is claimed is:

1. A fuel flow limiter assembly comprising:

a limiter body defining a longitudinal axis extending between a first axial body end and a second axial body end, and including an axially extending central bore, and a fuel inlet formed in the first axial body end and fluidly connected to the central bore;

a connector coupled to the second axial body end, and including a fuel outlet fluidly connected to the central bore and a connector seat adjacent to the fuel outlet and extending circumferentially around the fuel outlet;

a shutoff piston within the central bore and including a closing hydraulic surface exposed to a fluid pressure of the fuel inlet, and a sealing surface, and the shutoff piston being movable within the central bore in a direction of the second axial body end from an open position, to a closed position where the sealing surface is in contact with the connector to block fuel flow from the fuel inlet to the fuel outlet;

a biasing spring trapped between the shutoff piston and the connector and biasing the shutoff piston toward the open position; and a fuel filter supported in the connector, and projecting from the connector in the direction of the first axial body end in a fuel flow path from the fuel inlet to the fuel outlet.

2. The fuel flow limiter assembly of claim 1 wherein the fuel filter includes an elongate filter body having an open outlet end supported in the connector, and an unsupported second end opposite the open outlet end and positioned within the central bore.

3. The fuel flow limiter assembly of claim 2 wherein the outlet end is interference-fitted with the connector within the fuel outlet.

4. The fuel flow limiter assembly of claim 2 wherein the fuel filter includes a perforated cylindrical wall extending between the outlet end and the second end and circumferentially around the longitudinal axis.

5. The fuel flow limiter assembly of claim 1 wherein the limiter body further includes a counterbore formed in the second axial body end, and the connector includes a junction block positioned in the counterbore and having a connector seat extending circumferentially around the fuel outlet.

6. The fuel flow limiter assembly of claim 5 wherein:

the junction block includes a spring bore coaxially arranged with the fuel outlet about the longitudinal axis, and extending between the fuel outlet and the central bore;

the shutoff piston includes a head portion having the closing hydraulic surface formed thereon, and a skirt portion extending circumferentially around the longitudinal axis; and the biasing spring is received within the skirt portion and within the spring bore.

7. The fuel flow limiter assembly of claim 6 further comprising a spacer trapped between the biasing spring and the connector within the spring bore.

8. The fuel flow limiter assembly of claim 6 wherein the sealing surface includes an annular sealing edge forming a terminal end of the skirt portion.

9. A fuel system for an internal combustion engine comprising:

a pressurized fuel reservoir;

a plurality of fuel injectors fluidly connected to the pressurized fuel reservoir;

a plurality of flow limiter assemblies each positioned fluidly between the pressurized fuel reservoir and at least one of the plurality of fuel injectors;

each of the plurality of flow limiter assemblies defining a longitudinal axis and including a fuel inlet, a fuel outlet, a central bore, a biasing spring, and a shutoff piston positioned in the central bore and movable in opposition to a bias of the biasing spring to a closed position based on a fuel pressure drop from the fuel inlet to the fuel outlet; and each of the plurality of flow limiter assemblies further including a fuel filter having an outer filter inlet surface exposed to a flow of fuel in the central bore, and an inner filter outlet surface forming a filtered fuel passage extending to the fuel outlet, in the respective flow limiter assembly.

10. The fuel system of claim 9 wherein the filter inlet surface and the filter outlet surface each extend circumferentially around the longitudinal axis in the respective flow limiter assembly.

11. The fuel system of claim 10 wherein each of the fuel filters includes a perforated wall having the filter inlet surface and the filter outlet surface formed thereon and extending between an open outlet end supported in the respective flow limiter assembly and an unsupported second end positioned in the central bore.

12. The fuel system of claim 11 wherein each of the flow limiter assemblies includes a limiter body and a junction block coupled to the limiter body and having the fuel outlet formed therein.

13. The fuel system of claim 12 wherein each of the fuel filters is interference-fitted with the junction block within the fuel outlet.

14. The fuel system of claim 12 wherein the junction block includes a spring bore receiving the biasing spring, and coaxially arranged with the fuel outlet about the longitudinal axis, in the respective flow limiter assembly.

15. The fuel system of claim 14 wherein the shutoff piston includes a head portion having a closing hydraulic surface exposed to a fluid pressure of the fuel inlet, and a skirt portion including a sealing surface in contact with the junction block at the closed position of the shutoff piston.

16. The fuel system of claim 9 further comprising a plurality of leakage containment housings receiving the plurality of flow limiters, and a plurality of seals fluidly sealing the plurality of flow limiters within the plurality of leakage containment housings.

17. A fuel feed subsystem for a fuel injector comprising:

a leakage containment housing structured to couple with a pressurized fuel reservoir;

a fuel flow limiter assembly within the leakage containment housing, and including a limiter body defining a longitudinal axis, and a connector coupled to the limiter body;

the limiter body having a fuel inlet formed therein and an axially extending central bore fluidly connected to the fuel inlet;

the connector having a fuel outlet formed therein and fluidly connected to the central bore;

the fuel flow limiter assembly further including a biasing spring, and a shutoff piston including a closing hydraulic surface exposed to a fluid pressure of the fuel inlet, and a sealing surface, and being movable within the central bore in opposition to a biasing force of the biasing spring from an open position to a closed position to block fuel flow from the fuel inlet to the fuel outlet; and a fuel filter resident in the fuel flow limiter assembly and supported in the connector such that the fuel filter projects from the connector in an upstream direction relative to a fuel flow path from the fuel inlet to the fuel outlet and is partially within the shutoff piston.

18. The fuel feed subsystem of claim 17 wherein the fuel filter includes an elongate perforated body supported within the connector.

19. The fuel feed subsystem of claim 18 wherein the fuel filter, the biasing spring, and the shutoff piston are coaxially arranged, and the biasing spring is received partially within the shutoff piston and partially within the connector.

20. The fuel feed system of claim 19 wherein the fuel filter includes an open outlet end interference-fitted within the fuel outlet, and an opposite unsupported end that is axially within the shutoff piston at the open position and at the closed position.

* * * * *